US006116136A

United States Patent [19]

Kirschner et al.

[11] Patent Number: 6,116,136

[45] Date of Patent: Sep. 12, 2000

[54] ACTUATED RECOIL ABSORBING MOUNTING SYSTEM FOR USE WITH AN UNDERWATER GUN

[75] Inventors: Ivan N. Kirschner, Portsmouth; Gary R. Berlam, Warwick, both of R.I.

[73] Assignee: The United States of America as represented by the Secretary of Navy, Washington, D.C.

[21] Appl. No.: 09/054,315

[22] Filed: Mar. 31, 1998

[51] Int. Cl.[7] ..... F41A 25/18

[52] U.S. Cl. ..... 89/43.01; 89/87.14

[58] Field of Search ..... 89/43.01, 37.14, 89/42.01

[56] References Cited

U.S. PATENT DOCUMENTS

| | | | |
|---|---|---|---|
| 420,170 | 1/1890 | Seabury | 89/43.01 |
| 473,939 | 5/1892 | Mason | 89/43.01 |
| 703,900 | 7/1902 | Deinlein | 89/43.01 |
| 715,839 | 12/1902 | McClean | 89/43.01 |
| 1,754,943 | 4/1930 | Hammar | 89/43.01 |
| 1,804,388 | 5/1931 | Conlon | 89/43.01 |
| 2,072,099 | 3/1937 | Davison | 89/43.01 |
| 2,269,297 | 1/1942 | White | 89/43.01 |
| 3,599,530 | 8/1971 | Seamands et al. | 89/43.01 |
| 5,210,370 | 5/1993 | Mraz et al. | 89/43.01 |
| 5,608,180 | 3/1997 | Balbo et al. | 89/43.01 |
| 5,746,018 | 5/1998 | Kirschner et al. | 89/14.4 |

FOREIGN PATENT DOCUMENTS

| | | | |
|---|---|---|---|
| 117829 | 5/1946 | Australia | 89/43.01 |
| 641033 | 1/1937 | Germany | 89/43.01 |

*Primary Examiner*—Stephen M. Johnson
*Attorney, Agent, or Firm*—Michael J. McGowan; James M. Kasischke; Prithvi C. Lall

[57] ABSTRACT

An actuated recoil absorbing mounting system is used to reduce recoil velocities and to absorb the recoil energy from an underwater projectile launcher, such as a high discharge energy underwater gun. The recoil absorbing mounting system includes a projectile launcher frame that supports the projectile launcher during firing. The projectile launcher frame is slideably supported by one or more launcher frame supports to allow movement substantially in a linear direction. One or more recoil plates are coupled to the underwater projectile launcher frame to provide hydrodynamic added or virtual mass and damping to the projectile launcher frame and projectile launcher. The recoil absorbing mounting system further includes one or more actuators for repositioning or returning the projectile launcher frame and projectile launcher to an original position after firing.

10 Claims, 3 Drawing Sheets

ACTUATED RECOIL ABSORBING MOUNTING SYSTEM FOR USE WITH AN UNDERWATER GUN

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention relates to recoil absorbing mounts for projectile launchers and in particular, to a recoil absorbing mount using hydrodynamic added mass to decrease recoil velocities and hydrodynamic damping to absorb recoil energy in an underwater environment.

(2) Description of the Prior Art

The development of underwater projectile launchers, such as underwater guns which fire supercavitating bullets, requires that the new projectile launchers be tested. The firing of projectile launchers involving a high discharge energy results in a recoil that may affect the accuracy or testing of the launcher. To accurately test such projectile launchers and to implement such devices, the projectile launcher must be mounted in such a way that the recoil from the high discharge energy is sufficiently absorbed.

Some prior art recoil mounts used with guns include U.S. Pat. No. 2,817,233 to Dower, et al, U.S. Pat. No. 2,729,975 to Hawthorne, et al, U.S. Pat. No. 2,273,878 to Magrum, et al, U.S. Pat. No. 2,309,807 to Trotter, and U.S. Pat. No. 2,333,398 to Trotter, et al. These patents do not, however, disclose a simple device that effectively absorbs recoil from an underwater high discharge energy gun, such as by providing added mass to the gun. Inventions using added mass plates are, however, known in the art. None of the prior art discloses a recoil absorbing mount having an actuator used with an underwater projectile launcher in an underwater environment.

SUMMARY OF THE INVENTION

Accordingly, one object of the present invention is to provide a recoil absorbing mounting system that provides hydrodynamic added mass to the projectile launcher absorbing recoil energy. A further object of the present invention is to provide a recoil absorbing mounting system that can be used in an underwater environment with an underwater projectile launcher by providing hydrodynamic added mass to the projectile launcher. A further object of the present invention is to provide a recoil absorbing mounting system that combines added mass recoil absorption with an actuator for repositioning the projectile launcher after firing.

The present invention features a recoil absorbing mounting system that includes a projectile launcher frame for supporting the projectile launcher and for moving in a substantially linear direction, and at least one recoil plate coupled to the projectile launcher frame. The recoil plate provides hydrodynamic added mass and damping to the projectile launcher frame and projectile launcher, reducing recoil velocities and absorbing the recoil energy during launching of a projectile.

According to a preferred embodiment, the recoil absorbing mounting system includes at least one launcher frame support, for slideably supporting the projectile launcher frame and allowing movement in a substantially linear direction. The recoil absorbing mounting system further includes at least one actuator coupled between the projectile launcher frame and the launcher frame support. The actuator applies a substantially linear force to the projectile launcher frame, for repositioning the projectile launcher frame, the projectile launcher and the recoil plate after launching the projectile. According to different embodiments, the actuator includes, but is not limited to, a hydraulic actuator, a pneumatic actuator and an electrical actuator.

The projectile launcher frame includes a gun clamp or other suitable connection for rigidly supporting the projectile launcher, and a second end rigidly supporting the firing chamber of the projectile launcher. According to one embodiment, the recoil plate is coupled at the second end of the projectile launcher frame behind the muzzle of the projectile launcher. According to an alternative embodiment, a plurality of recoil plates are coupled, in a series, to the projectile launcher frame for further increasing the hydrodynamic added mass and damping.

According to an alternative embodiment, the recoil absorbing mounting system includes at least one roller disposed between the launcher frame support and the projectile launcher frame, to facilitate the substantially linear motion of the projectile launcher frame with respect to the launcher frame support.

BRIEF DESCRIPTION OF THE DRAWINGS

These and other features and advantages of the present invention will be better understood in view of the following description of the invention taken together with the drawings wherein.

DESCRIPTION OF THE PREFERRED EMBODIMENT

Figure 1:
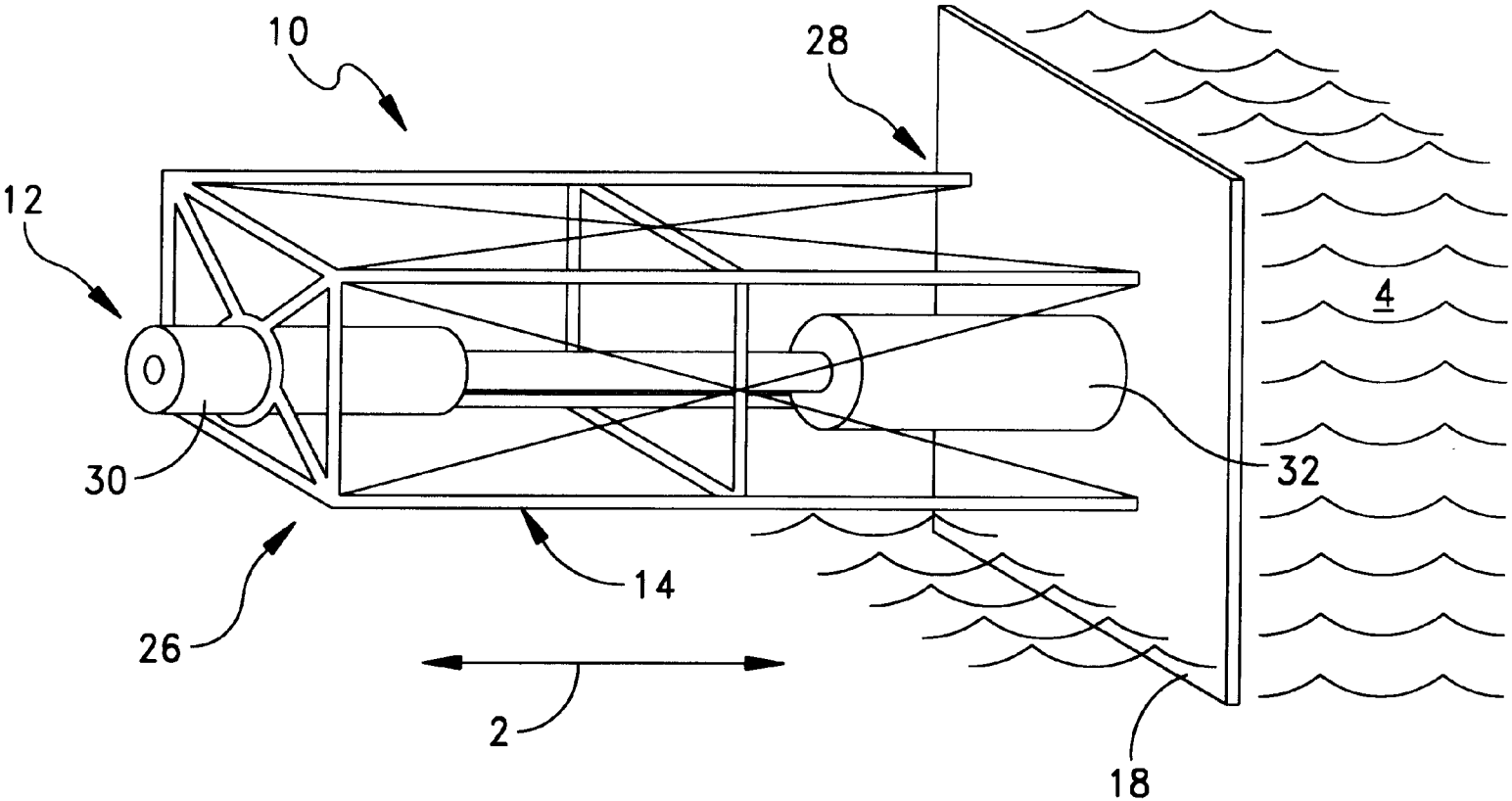
FIG. 1 (PRIOR ART)
FIG. 1 is a perspective view of a projectile launcher, a projectile launcher frame and a recoil plate according to the prior art.

A recoil absorbing mounting system 10, FIG. 1, is used to mount an underwater projectile launcher 12 and uses hydrodynamic added or virtual mass recoil absorption to absorb recoil energy and to reduce recoil velocity from a projectile launcher 12. The recoil absorbing mounting system 10 is preferably used in an underwater environment with an underwater projectile launcher 12. One type of projectile launcher 12 includes an underwater gun that fires supercavitating bullets underwater and has a high discharge energy. However, the present invention contemplates using the concept of added (or virtual) mass recoil absorption in combination with an actuator mechanism, described in greater detail below, with various types of projectile launchers or guns.

The recoil absorbing mount 10 includes a projectile launcher frame 14, for supporting the projectile launcher 12 while the projectile launcher 12 is fired, and one or more recoil plates 18. The recoil plate 18 is coupled to the projectile launcher frame 14 to provide added or virtual mass to the projectile launcher frame 14 and the projectile launcher 12 in order to reduce recoil velocities and to absorb recoil energy during launching of a projectile. The recoil plate 18 is surrounded by ambient water and provides hydrodynamic added mass caused by the accelerating water and hydrodynamic damping by shedding vortices in the immediate vicinity of the recoil plate 18 during firing of the projectile launcher 12.

The projectile launcher frame 14 includes a first end 26 and a second end 28. The first end 26 of the projectile launcher frame 14 preferably supports a muzzle 30 of the projectile launcher 12 by a system of one or more clamps or other connections. The second end 28 of the projectile launcher frame 14 supports a firing chamber 32 of the projectile launcher 12. According to one preferred embodiment, the recoil plate 18 is mounted behind the firing chamber 32 on the projectile launcher frame 14. The high discharge energy caused by firing the projectile launcher 12 is, therefore, effectively absorbed by the hydrodynamic damping of the recoil plate 18, while recoil velocities are reduced by the load of accelerating the hydrodynamic added mass in an underwater environment. The present invention also contemplates mounting the recoil plate 18 at any point along the projectile launcher frame 14, for example, on the muzzle end or first end 26 or on the projectile launcher 12 itself.

According to an exemplary embodiment, the projectile launcher frame 14 rigidly supports the projectile launcher, such as by a gun clamp or other means known in the art.

Figure 2:
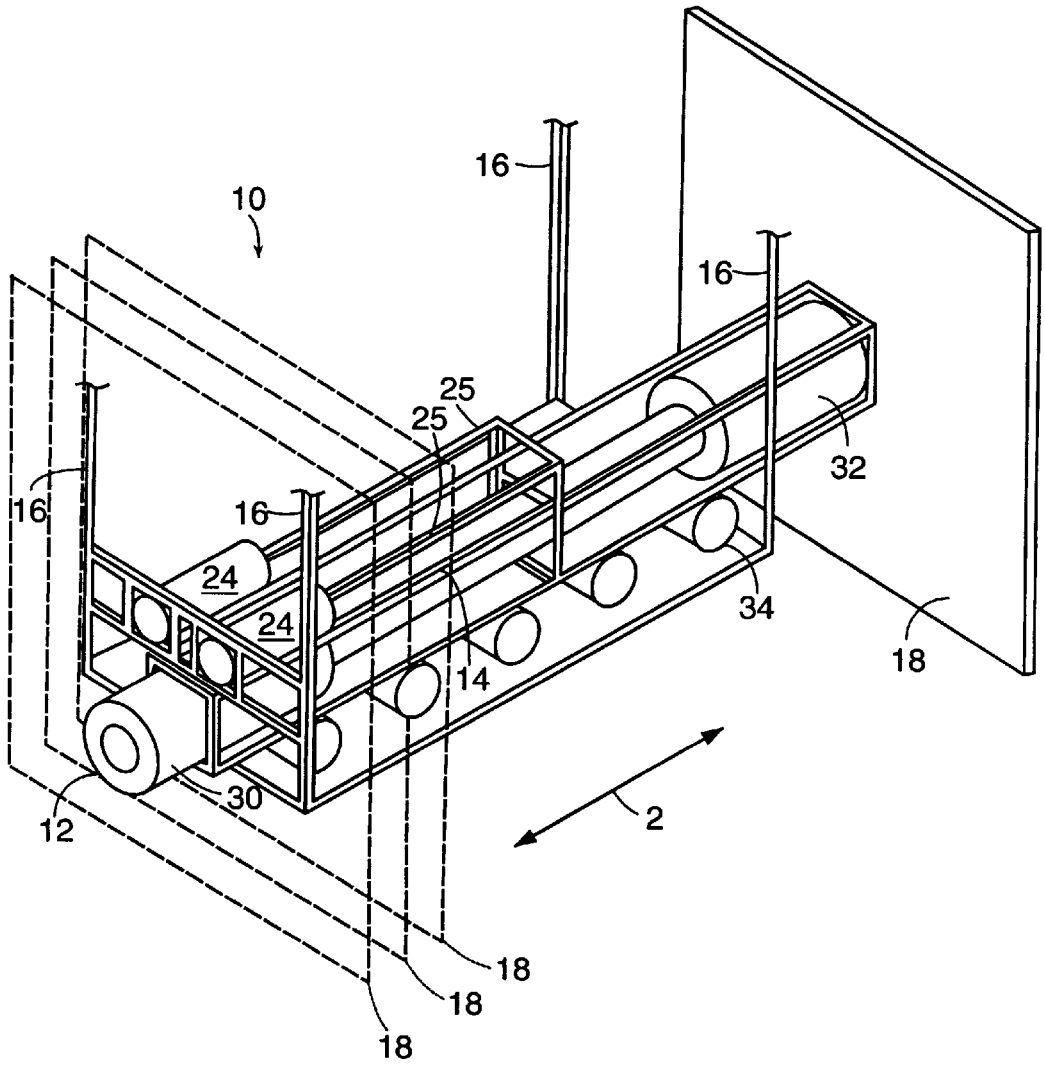
FIG. 2 is a side view of the recoil absorbing mounting system according to the present invention.

According to one embodiment of the present invention, the projectile launcher frame 14, FIG. 2, is slideably supported by one or more launcher frame supports 16. For example, the launcher frame supports 16 support the projectile launcher frame 14 in a way that allows the projectile launcher frame 14 to move in a substantially linear direction indicated by arrow 2 when the projectile launcher 12 is fired. According to one embodiment, each support 16 is mounted to a turret or other suitable fixture substantially rigidly attached to the launch vessel, platform or test facility. Four supports 16 are shown in FIG. 2, but the present invention contemplates any number of supports 16 to slideably support the projectile launcher frame 14 and allow movement in a substantially linear direction. One or more rollers 34 are disposed between the projectile launcher frame 14 and the launcher frame supports 16 facilitating this linear motion. The present invention further contemplates any other type of mechanical expedient that reduces friction and facilitates linear motion.

Also, according to the embodiment, the recoil absorbing mount 10 further includes one or more actuators 24 coupled between the projectile launcher frame 14 and one of the launcher frame supports 16 by at least one link 25. The actuators 24 act to reposition the projectile launcher frame 14 and projectile launcher 12 after the projectile launcher 12 has been fired, for example, by providing a linear force to the projectile launcher frame 14. According to various embodiments, the actuator 24 includes hydraulic actuators, pneumatic actuators or electrical actuators. Hydraulic and pneumatic actuators will provide additional damping to projectile launcher frame 14 and projectile launcher 12 during firing.

Figure 3:
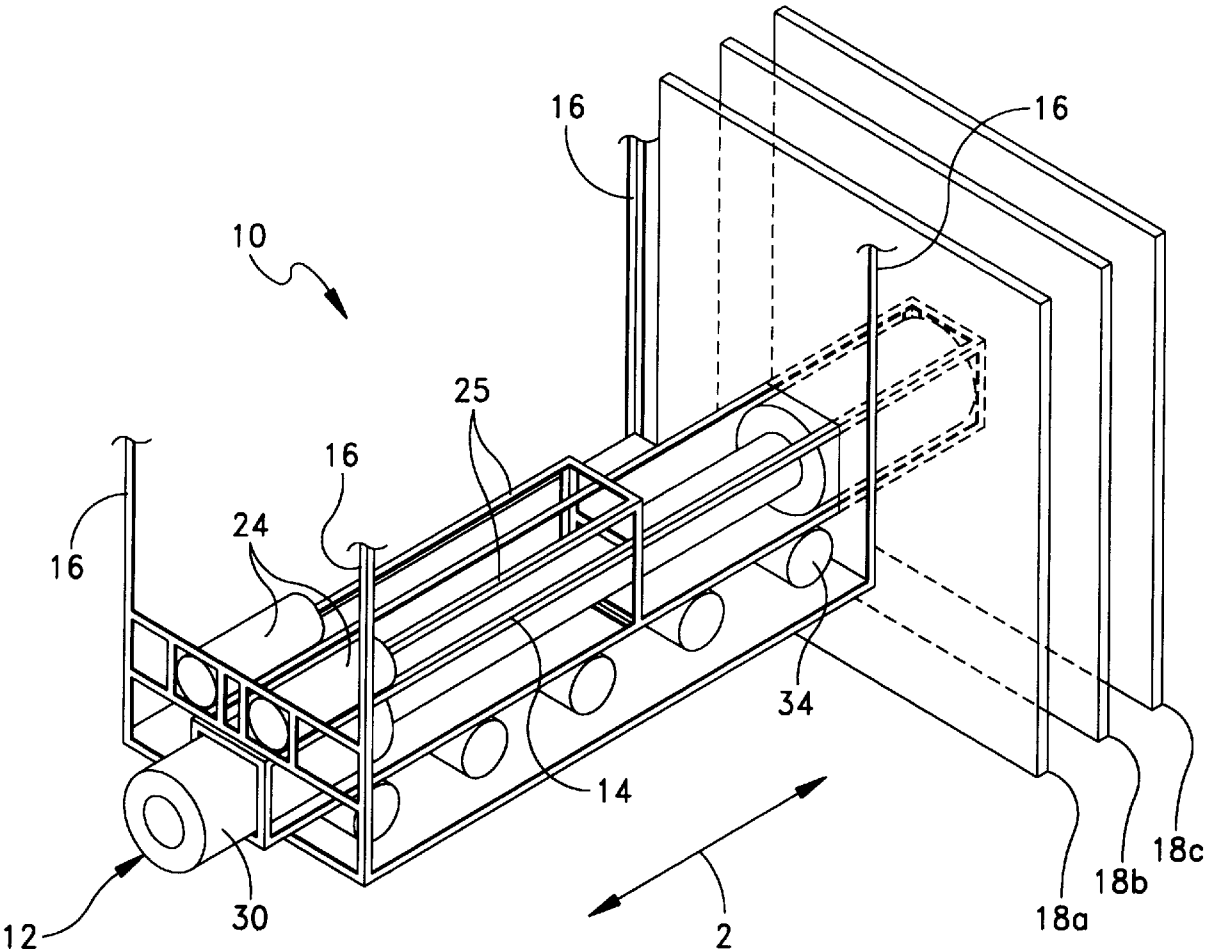
FIG. 3 is a perspective view of a projectile launcher frame, projectile launcher, recoil plates, and support according to another embodiment of the present invention.

According to another embodiment, the recoil absorbing mounting system 10, FIG. 3, includes a plurality of recoil plates 18*a*–18*c* mounted in series along the projectile launcher frame 14 to increase the effective hydrodynamic added or virtual mass. The recoil absorbing mounting system according to the present invention uses the added or virtual mass of one or more plates to absorb recoil energy from a high discharge energy projectile launcher. Using the added mass recoil absorption technique provides a simple recoil absorbing mounting system that is particularly effective in an underwater environment.

In light of the above, it is therefore understood that within the scope of the appended claims, the invention may be practiced otherwise than as specifically described.

What is claimed is:

1. A recoil absorbing mounting system, for use with a projectile launcher in an underwater environment, said recoil absorbing mounting system comprising:

a projectile launcher frame capable of supporting said projectile launcher;

at least one launcher frame support supporting said projectile launcher frame and allowing movement of said projectile launcher frame in a substantially linear direction;

at least one recoil plate coupled to said projectile launcher frame and positioned in contact with water from said underwater environment, each said plate being adapted to provide hydrodynamic damping for absorbing recoil energy and reducing recoil velocities during launching of a projectile; and at least one actuator coupled between said projectile launcher frame and said at least one launcher frame support, said actuator applying a substantially linear force to said projectile launcher frame for repositioning said projectile launcher frame and said recoil plate after launching said projectile.

2. The recoil absorbing mounting system of claim 1 wherein said actuator includes a hydraulic actuator.

3. The recoil absorbing mounting system of claim 1 wherein said actuator includes a pneumatic actuator.

4. The recoil absorbing mounting system of claim 1 wherein said actuator includes an electrical actuator.

5. The recoil absorbing mounting system of claim 1 further including at least one roller disposed between said at least one launcher frame support and said projectile launcher frame, wherein said at least one roller facilitates substantially linear motion of the said projectile launcher frame with respect to said at least one launcher frame support as said at least one launcher frame support slideably supports said projectile launcher frame.

6. The recoil absorbing mounting system of claim 1 wherein said projectile launcher frame includes a muzzle end for rigidly supporting a muzzle of said projectile launcher, and a second end for rigidly supporting a firing chamber of said projectile launcher.

7. The recoil absorbing mounting system of claim 6 wherein said at least one recoil plate is coupled at said second end of said projectile launcher frame.

8. The recoil absorbing mounting system of claim 6 wherein said at least one recoil plate is coupled at said muzzle end of said projectile launcher frame.

9. The recoil absorbing mounting system of claim 1 further including a plurality of recoil plates coupled in a series to said projectile launcher frame.

10. A recoil absorbing mounting system, for use with a projectile launcher in an underwater environment, said recoil absorbing mounting system comprising:

a projectile launcher frame capable of supporting said projectile launcher;

at least one launcher frame support supporting said projectile launcher frame and allowing movement of said projectile launcher frame in a substantially linear direction;

a plurality of recoil plates coupled in a series to said projectile launcher frame and positioned in contact with water from said underwater environment, each said plate being adapted to provide hydrodynamic damping for absorbing recoil energy and reducing recoil velocities during launching of a projectile;

at least one roller disposed between said at least one launcher frame support and said projectile launcher frame, wherein said at least one roller facilitates substantially linear motion of the said projectile launcher frame with respect to said at least one launcher frame support as said at least one launcher frame support slideably supports said projectile launcher frame; and at least one actuator coupled between said projectile launcher frame and said at least one launcher frame support, said actuator applying a substantially linear force to said projectile launcher frame for repositioning said projectile launcher frame and said recoil plate after launching said projectile.

* * * * *